US006407047B1

(12) United States Patent
Mehta et al.

(10) Patent No.: US 6,407,047 B1
(45) Date of Patent: Jun. 18, 2002

(54) COMPOSITION FOR DESMUTTING ALUMINUM

(75) Inventors: Maulik Dhanesh Mehta, Charlotte, NC (US); Paul Andrew Butkovsky, Lancaster, SC (US)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 09/772,404

(22) Filed: Jan. 30, 2001

Related U.S. Application Data

(60) Provisional application No. 60/182,962, filed on Feb. 16, 2000.

(51) Int. Cl.[7] ..... C11D 14/02; C11D 3/22; C23G 14/02; C23G 3/22

(52) U.S. Cl. ..... 510/254; 510/245; 510/257

(58) Field of Search ..... 510/245, 254, 510/257

(56) References Cited

U.S. PATENT DOCUMENTS 3,634,262 A * 1/1972 Grunwald et al. ..... 252/100
4,124,407 A * 11/1978 Binns ..... 134/3
4,230,522 A * 10/1980 Martin et al. ..... 156/638
4,346,128 A * 8/1982 Loch ..... 427/328
4,883,541 A * 11/1989 Tadros ..... 134/3
5,104,484 A * 4/1992 Nakanishi et al. ..... 156/651

* cited by examiner

*Primary Examiner*—Yogendra N. Gupta
*Assistant Examiner*—John M Petruncio
(74) *Attorney, Agent, or Firm*—Gilbert W. Rudman; Stanley A. Marcus

(57) ABSTRACT

This invention provides an improved composition and process for pretreatment of aluminum prior to electroplating. The invention is an aqueous composition comprised of an acid, an oxidizing agent, and, optionally, a halogenated compound.

This composition is useful in a process that effectively removes smut that results from the etching step of the aluminum pretreatment process.

Alternatively, the composition can be used in a process which combines the etch and desmut steps in Al pretreatment.

11 Claims, No Drawings

COMPOSITION FOR DESMUTTING ALUMINUM

This application claim priority from Provisional application Ser. No. 60/182,962, filed Feb. 16, 2000.

BACKGROUND OF THE INVENTION

1. Field of the Invention

The field of this invention is compositions for desmutting aluminum and aluminum alloy surfaces prior to electroplating by the controlled removal of metals and oxides that would interfere with electroplating processes.

2. Description of the Prior Art

It has long been recognized that aluminum and its alloys require specific surface preparation processes to ensure successful electroplating. The main reason for this is the high affinity that aluminum has for oxygen and, as a result, the relatively quick rate at which a clean, oxide-free aluminum surface will re-oxidize. This oxide layer has been shown to negatively affect adhesion of electroplated coatings on aluminum if it is not properly controlled.

Pretreatment of aluminum metal prior to electroplating generally involves steps including 1) cleaning, 2) etching, 3) desmutting, and 4) zincating.

Cleaning is performed to remove the various oils, greases, grits, soils, and dirts that are present from material handling, corrosion protection, or other surface preparation. Cleaning can involve an array of chemistries and processes including aqueous chemistries, solvent degreasing, vapor processes, emulsions, ultrasonics, thermal oxidation, plasma discharge, etc. Aqueous cleaning by immersion is the most popular process.

After cleaning, aluminum is typically immersed in an alkaline or acid solution to etch or roughen the surface and remove the heavy oxide layer. Etching of the surface is thought to promote adhesion by increasing the surface area and providing better mechanical interlocking between the coating and the aluminum substrate. Removal of the oxide layer further improves the electroplating process by making the surface more electrochemically active and by removal of a potentially weak intermediate oxide layer between the metal coating and the substrate.

The type of etching employed depends on the aluminum alloy, processing conditions, and the condition of the surface. Generally, alkaline etchants are designed to be more aggressive, produce a rougher surface to promote adhesion and are particularly effective for heavily oxidized alloys. Acidic etchants, in contrast, are significantly milder on the aluminum surface. They reduce the potential for exposure of large metal inclusions or sub-surface casting voids within an alloy and generally minimize the amount of smut to be removed downstream since there is less etching.

An examination of the aluminum surface after etching typically reveals the presence of a loosely adherent film or smut on the surface, which negatively impacts adhesion of subsequent plating to the aluminum. The composition of this smut depends on the impurities or alloy constituents in the aluminum, and generally contains metallic constituents. Thus, after etch treatment, the substrate is subjected to a process (desmutting) to remove the smut layer.

Desmutting is generally followed by a zincating process, where the aluminum is immersed in an alkaline zinc bath to deposit a thin zinc-containing layer. The zincate layer controls and minimizes oxidation of the metal surface since zinc does not oxidize nearly as rapidly as aluminum. A typical process sequence after desmutting includes water rinsing, zincating, chemical stripping of the zincate layer (in a solution which attacks the zincate, typically nitric acid-containing), zincating the surface again, followed by coating the surface with an electrolytic nickel strike. Subsequent plating operations (e.g. Cu/Ni/Cr) can follow the nickel strike. Practice has shown the benefit of the double zincating process generally described above to further improve coating adhesion over that which would result from a single zincate process.

Experience has shown that desmutting is often the most critical step in the aluminum pretreatment process. Historically, nitric acid solutions, with acid concentrations of 25% to 70% typically, have performed well to desmut etched aluminum alloys. Not all smut is easily removed with nitric acid alone, thus often additions are made to improve the effectiveness of the desmut. For instance, for aluminum alloys containing high concentrations of silicon (e.g. 356A and 380 series cast alloys), additions of fluoride-containing compounds such as ammonium bifluoride or sodium fluoride, have been added such that fluoride ions are available to dissolve and remove silicon from the surface. Alternatively, a solution of nitric acid, sulfuric acid and a fluoride-containing salt has gained popularity over the years, because of its ability to chemically attack a wider variety of metallic smuts. This composition is particularly useful for alloying metals such as Cu, Fe, Mg and Si, since the sulfate is an effective solvent.

While nitric acid has been very effective for desmutting etched aluminum, there has been increased resistance to its use because of safety and health concerns. For instance, development of toxic NOx fumes in nitric acid-containing baths has been of particular concern. To obviate this concern, there has been significant effort to develop and use non-nitric acid containing desmuts. One such approach has employed use of chromic acid as the oxidant, again combined with sulfuric acid and a fluoride-containing salt. While this approach has been successful for desmutting and avoids NOx creation, use of chromic acid brings with it toxicity concerns of its own.

An object of the present invention is to provide a composition that is free of nitric acid and chromic acid, thus eliminating the health, safety, and environmental concerns associated with these acids, but which is capable of being highly effective in its desmutting ability.

SUMMARY OF THE INVENTION

This invention provides an improved composition and process for pretreatment of aluminum prior to electroplating. The invention is an aqueous composition comprised of an acid, an oxidizing agent, and, optionally, a halogenated compound.

This composition is useful in a process that effectively removes smut that results from the etching step of the aluminum pretreatment process.

Alternatively, the composition can be used in a process which combines the etch and desmut steps in Al pretreatment.

DETAILED DESCRIPTION OF THE INVENTION

The composition of the present invention provides a formulation to treat aluminum surfaces, prior to metal coating(s), for the purpose of making aluminum surfaces acceptable for the adherence of subsequent coatings. The treatment is sometimes referred to in industry as a desmutting or deoxidizing procedure.

The aqueous composition for desmutting an aluminum surface which includes:

a-an oxidant, b-an acid, and c-optionally, a halide ion-containing compound.

The oxidant can be one or more compounds; all of which have a high affinity for additional oxygen. A group of oxidants that are included in this group are the so-called "per" oxidizing agents which include sodium persulfate; potassium persulfate; ammonium persulfate; sodium peroxysulfuric; potassium peroxysulfuric; perborates, percarbonates, and peroxides. Other oxidants that may be included are ammonium nitrate; sodium nitrate; potassium nitrate; copper nitrate; iron nitrate; magnesium nitrate; and manganese nitrate. Another group that may be included as oxidants are the aromatic di- & tri-substituted compounds such as meta-, ortho-, or para- nitro aryl acids; or nitro aryl sulfonic acids and their salts. Included in this group are 1-,2-, and 3-nitrobenzenesulfonic acids, 1-,2-, and 3-nitrobenzene acids, and the sodium, potassium, and ammonium salts of these acids.

The preferred oxidants are meta-, ortho-, or para- nitro aryl acids, nitro aryl sulfonic acids, benzenesulfonic acids and their salts, esters and amides. These include benzenesulfonic acid, 4-ethylbenzenesulfonic acid; 3-nitrobenzenesulfonic acid, and their salts.

The most preferred are meta-, ortho-, or para nitro aryl sulfonic acids, particularly, nitrobenzene sulfonic acids.

Meta-nitrobenzene sulfonic acid (MBS) has been found to be particularly desirable compared to the "per" oxidizing agents or the nitrate-based compounds for several reasons. First, MBS is much more stable at the pH's found useful for desmutting, whereas compounds such as Na persulfate must be stabilized to prevent breakdown products. This stability has the effect of improving the consistency of etch over time, thus extending the useful life of the desmut. MBS also is compatible with halogenated compounds such as ammonium bifluoride or sodium fluoride. This allows stable incorporation of halogenated salts, which are often needed for successful desmutting of silicon rich compounds. Halogenated compounds are often not recommended for use with "peroxy" compounds because of the potential for breakdown, liberation of halide gas and subsequent decrease in the concentration of active halide compound over time. Safety is another consideration addressed by MBS when compared to the "per" oxidizing agents or the nitrate-based compounds since exotherms upon mixing are a common problem with the latter compounds. Finally experimental evidence exists that MBS-based desmuts are more tolerant to copper in the bath compared to "peroxy" or nitrate-based desmuts, since the bath can hold more copper in solution before immersion plating of copper occurs. Again, this feature extends the life compared to the competitive baths.

The acid function in this chemistry can be met using either mineral or organic acids.

Mineral acids that can be included within this formulation including: ortho phosphoric acid, polyphosphoric acid, hypophosphorous acid, metaphosphoric acid, pyrophosphoric acid, sulfuric acid, or fluoroboric acid.

Organic acids include acetic, gluconic, glycollic, chloroacetic, di-chloroacetic, and tri-chloroacetic acid. Other acids that will perform this function include methanesulfonic acid, ethanesulfonic acid, propanesulfonic acid, and butanesulfonic acid.

Sulfuric acid is preferred because of its availability, cost and standard use in processes of this nature.

The purpose of these acids either alone or in combination with an oxidant is to remove, dissolve, or complex any smut or metal impurities formed on the aluminum surface. The removal of these metal impurities and oxides will insure good adhesion of metal coatings. Sulfuric acid has been shown in laboratory experiments to perform well for the acid function of the formulation for a range of aluminum alloys including 356-A, 2024, and 6061 alloys.

When the formulation is employed for cleaning the surface of an aluminum-silicon alloy by the controlled removal of silicon, other minimal alloying metals, and oxides from the surface, a compound having a halide ion, preferably, fluoride, is also included in the formulation. The source of the ion may be any halide salt including either mono- or di-halogenated sodium, potassium or ammonium salts such as ammonium bifluoride, sodium bifluoride, potassium bifluoride, sodium fluoride, ammonium fluoride, or hydrofluoric acid.

The composition of the aqueous solution comprises:

a) oxidant: 0.5 to about 200 g/L b) acid: 1.0% to about 50% by vol.

c) halide containing compound: 0.0 to about 100 g/L.

A preferred composition of the aqueous solution comprises:

20–40 g/L oxidant

5–20% by volume of concentrated (97–98%) acid

2–3 g/L Fluoride containing compound

A preferred composition is:

a) m-nitrobenzene sulfonic acid, sodium salt: 0.5 to about 200 g/L b) Sulfuric acid: 1% to about 50% by volume c) Fluoride-ion: 0.2 to about 100 g/L A particularly preferred embodiment is comprised of about 20–40 g/L MBS about 5–15% by volume of concentrated (97–98%) sulfuric acid about 1–5 g/L Ammonium Hydrogen Fluoride The advantages of this formulation are that it is an excellent remover of oxide in combination with alkaline/acid etch or as a single step, produces relatively low dissolution of the aluminum substrate, does not impede on adhesion when EN plating, and is much safer than alternative chemistries.

Changes in the formulation are possible, however it should be noted that at lower concentrations of acid, oxide removal is poor (on castings and wrought alloys) but adhesion is not a problem. The acid levels can be varied anywhere between 1% - - - 50% to obtain maximum removal of oxides with no loss in adhesion.

The amount of MBS in solution is also very critical, in that any concentrations less than 15 g/L result in a loss of adhesion when used in conjunction with sulfuric acid and ammonium hydrogen fluoride. This concentration has been adjusted to high 90g/L with good resultant adhesion, but advantages of this concentration of MBS over lower levels were not apparent.

The practice of this invention may be further appreciated by consideration of the following, non-limiting examples.

EXAMPLE 1

Three different aluminum alloys are tested in the experiment; 356-A (UNS number 13560), 2024 (UNS number A92024), 6061 (UNS number 96061). These alloys are three of the most common alloys used in the plating industry, and are good representatives of the two categories for aluminum alloys (cast & wrought).

Each experiment includes 7 to 10, 1"×4"×⅛", strips of the respective alloy, to confirm the observed results. Etch rates reported are an average of the rates measured on all strips. All strips are pretreated according to the steps below:

Rinsed in DI water

Immersed in acetone for 10 minutes

Rinsed w/ DI water

Immersed in 2-propanol for 10 minutes

Heated for 30 minutes @ 250° F.

Cooled to Room temperature

Processed through Alklean 77 & Desmut Branded products and processes used in the examples are as follows:

ALKLEAN 77, marketed by Atotech, Rock Hill, N.C., is a 100% active alkaline etchant containing chelating agents and an inhibiting grain refining agent.

ALUMECH G, marketed by Atotech, Rock Hill, N.C., is an acidic , highly concentrated aqueous solution formulated to deoxidize, desmut and condition the surface of certain aluminum alloys for subsequent processing.

ALUMSEAL ACTIVATOR BD, marketed by Atotech, Rock Hill, N.C., when dissolved in water, is a highly stable solution for stripping zincate from aluminum.

ALUMSEAL NCY, marketed by Atotech, Rock Hill, N.C., is a non-cyanide zincate process designed specifically to facilitate plating of metallic deposits on aluminum alloys.

NICHEM 2500, marketed by Atotech, Rock Hill, N.C., is an advanced electroless nickel-plating process specially formulated to deposit a bright, medium phosphorus-nickel alloy on aluminum and ferrous based substrates by means of autocatalytic reduction.

Etch rates are determined from the weight changes of the strips, and the etch rates represent an average of all strips exposed to the same conditions. Two types of weight change tests are run.

All experiments use a composition comprised of, for the oxidant, meta-nitrobenzene sulfonic acid (MBS), for the acid, sulfuric acid, and for the fluoride-containing compound, ammonium hydrogen fluoride (ABF).

Alklean 77 is used as the etchant (for Example 1), and all experiments are run at room temperature. The immersion time in the etchant is 1 minute, and the immersion time in the desmut is for 2 minutes. Electroless nickel (EN) is used as the final coating in evaluating the appearance and adhesion for all Examples (1, 2 & 3).

EN is deposited after the desmut step by a process sequence consisting of:

1) Zincate Alumseal NCY (at room temperature, 45 seconds)
2) Zincate Strip Alumseal BD (sodium monopersulfate), (at room temperature, 20 seconds)
3) $2^{nd}$ Zincate Alumseal NCY, (at room temperature, 20 seconds)
4) Electroless Nickel Nichem 2500, (170–180° F., 60 minutes, 0.001" thickness)

The adhesion of the electroless nickel is checked via the bend tests, based on ASTM method: B 571-91.

Example 1 data represents potential candidate desmuts investigated experimentally in order to obtain a final and most successful formulation. The first two names are current existing products that have been used as control formulations. These two products contain nitric acid, along with other components, and have proved to be successful. The others are all experimental non-nitric formulations.

| Desmut Chemistry: | 356 alloy (mg/sec) | 2024 alloy (mg/sec) | 6061 alloy (mg/sec) | Active Oxygen Values | Copper in Solution: |
|---|---|---|---|---|---|
| Alumetch G | 1.01 (p)* | 0.25 (p) | 0.25 (p) | N/A | N/A |
| Triacid:nitric acid 50%; sulfuric acid 25%; water 25% 20 g/l ABF | 0.96 (p) | 0.25 (p) | 0.20 (p) | N/A | N/A |
| Persulfate/Bisulfate 30 g/L (with 5% sulfuric acid) | 0.09 (p) | 0.09 (f)* | 0.07 (p) | | |
| Persulfate/Bisulfate 60 g/L (with 5% sulfuric acid) | 0.08 (p) | 0.03 (f) | 0.03 (p) | Value is ½ After 3 hours | 2.5 grams dissolved in solution results in immersion plate on Al alloy after 2 Hrs |
| Persulfate/Bisulfate 120 g/L (with 5% sulfuric acid) | 0.14 (p) | 0.05 (p) | 0.04 (p) | | |
| Persulfate/Bisulfate 30 g/L (w/ 5% phosphoric acid) | 0.09 (p) | 0.07 (p) | 0.17 (p) | | |
| Persulfate/Bisulfate 60 g/L (w/ 5% phosphoric acid) | 0.13 (p) | 0.07 (p) | 0.15 (p) | Value is ½ After 3 hours | 2.5 grams dissolved in solution results in immersion plate on Al alloy after 2 Hrs |
| Persulfate/Bisulfate 120 g/L (w/ 5% phosphoric acid) | 0.15 (p) | 0.18 (p) | 0.22 (p) | | |
| Persulfate/Bisulfate 30 g/L (with MSA) | 0.12 (p) | 0.09 (p) | 0.06 (p) | | |
| Persulfate/Bisulfate 60 g/L | 0.15 | 0.16 | 0.14 | Value is ½ | 3.5 grams dissolved in solution results in |

-continued

| Desmut Chemistry: | 356 alloy (mg/sec) | 2024 alloy (mg/sec) | 6061 alloy (mg/sec) | Active Oxygen Values | Copper in Solution: |
|---|---|---|---|---|---|
| (with 5% MSA) | (p) | (p) | (p) | After 3 hours | immersion plate on Al alloy after 2 Hrs |
| Persulfate/Bisulfate 120 g/L | 0.16 | 0.16 | 0.13 | | |
| (with 5% MSA) | (p) | (p) | (p) | | |
| Phosphoric acid | 0.11 | 0.04 | 0.06 | | N/A |
| Gluconic acid 150–160° F. | (p) | (p) | (p) | | |
| Phosphoric acid | 0.10 | 0.05 | 0.04 | N/A | |
| Sulfuric acid Glycolic acid 150–160° F. | (p) | (p) | (p) | | |
| Sulfuric acid | 0.09 | 0.08 | 0.05 | N/A | N/A |
| Phosphoric acid F- | (p) | (p) | (p) | | |
| MBS 30 g/l | −0.05 | −0.05 | −0.04 | N/A | N/A |
| Sulfuric acid 0% ABF 2.5 g/L | (f) | (f) | (f) | | |
| MBS 30 g/l | 0.07 | 0.08 | 0.04 | N/A | N/A |
| Sulfuric acid 5% ABF 2.5 g/L | (p) | (p) | (p) | | |
| MBS 30 g/l | 0.35 | 0.44 | 0.24 | N/A | N/A |
| Sulfuric acid 5% ABF 10.0 g/L | (p) | (p) | (p) | | |
| MBS 30 g/l | 0.51 | 0.50 | 0.26 | N/A | N/A |
| Sulfuric acid 5% ABF 25 g/L | (p) | (p) | (p) | | |
| MBS 30 g/l | 0.07 | 0.08 | 0.04 | N/A | N/A |
| Sulfuric acid 10% ABF 2.5 g/L | (p) | (p) | (p) | | |
| MBS 30 g/l | 0.09 | 0.08 | 0.06 | N/A | N/A |
| Sulfuric acid 20% ABF 2.5 g/L | (p) | (p) | (p) | | |
| MBS 30 g/l | 0.043 | 0.04 | 0.02 | N/A | N/A |
| Sulfuric acid 10% ABF 0.0 g/L | (f) | (p) | (p) | | |
| MBS 60 g/l** | 0.09 | 0.08 | 0.04 | N/A | N/A |
| Sulfuric acid 10% ABF 2.5 g/L | (p) | (p) | (p) | | |
| MBS 10 g/l** | 0.06 | 0.09 | 0.05 | N/A | N/A |
| Sulfuric acid 10% ABF 2.5 g/L | (p) | (p) | (p) | | |

*(p) or (f) are noted for adhesion passed and/or adhesion failed, respectively.
**The 10 g/l MBS formulation has adequate adhesion of EN, but incomplete smut removal. The 60 g/l MBS formulation has both adequate adhesion of EN and sufficient smut removal.

EXAMPLE 2

This Example shows etch rates after immersion in Etch (Alkleen 77) & the desmut compositions.

| Formulation | 356 alloy (mg/sec) | | 2024 alloy (mg/sec) | | 6061 alloy (mg/sec) | |
|---|---|---|---|---|---|---|
| Process: | E + D | ad-hesion | E + D | ad-hesion | E + D | Ad-hesion |
| MBS: 30 g/L Sulfuric: 0% ABF: 2.5 g/L | 0.06 | Fail | −0.01 | Fail | −0.01 | Fail |
| MBS: 30 g/L Sulfuric: 5% ABF: 2.5 g/L | 0.29 | Pass | 0.15 | Pass | 0.10 | Pass |
| MBS: 30 g/L Sulfuric: 5% ABF: 10 g/L | 0.78 | Pass | 0.55 | Pass | 0.32 | Pass |
| MBS: 30 g/L Sulfuric: 5% ABF: 25 g/L | 1.24 | Pass | 0.63 | Pass | 0.33 | Pass |
| MBS: 30 g/L | 0.28 | Pass | 0.16 | Pass | 0.10 | Pass |

-continued

| Formulation | 356 alloy (mg/sec) | | 2024 alloy (mg/sec) | | 6061 alloy (mg/sec) | |
|---|---|---|---|---|---|---|
| Process: | E + D | ad-hesion | E + D | ad-hesion | E + D | Ad-hesion |
| Sulfuric: 10% ABF: 2.5 g/L MBS: 30 g/L Sulfuric: 20% ABF: 2.5 g/L | 0.26 | Pass | 0.15 | Pass | 0.10 | Pass |

EXAMPLE 3

This example shows etch rates after immersion in desmut compositions without use of a prior etch.

| | 356 alloy | 2024 alloy | 6061 alloy |
|---|---|---|---|

| Formulation | (mg/sec) | | (mg/sec) | | (mg/sec) | |
|---|---|---|---|---|---|---|
| Process: | D | Ad-hesion | D | Ad-hesion | D | Ad-hesion |
| MBS: 30 g/L Sulfuric: 0% ABF: 2.5 g/L | −0.05 | Fail | −0.05 | Fail | −0.04 | Fail |
| MBS: 30 g/L Sulfuric: 5% ABF: 2.5 g/L | 0.07 | Pass | 0.08 | Pass | 0.04 | Pass |
| MBS: 30 g/L Sulfuric: 5% ABF: 10 g/L | 0.35 | Pass | 0.44 | Pass | 0.24 | Pass |
| MBS: 30 g/L Sulfuric: 5% ABF: 25 g/L | 0.51 | Pass | 0.50 | Pass | 0.26 | Pass |
| MBS: 30 g/L Sulfuric: 10% ABF: 2.5 g/L | 0.07 | Pass | 0.08 | Pass | 0.04 | Pass |
| MBS: 30 g/L Sulfuric: 20% ABF: 2.5 g/L | 0.09 | Pass | 0.08 | Pass | 0.06 | Pass |

EXAMPLE 4

Although adhesion is an important criterion for a successful formulation, it is certainly not the only one. The level of smut (oxide) remaining after etching & desmut, as well as the amount elemental copper present in solution (after processing 2XX.X and 2XXX series alloys) are two important factors to consider. From all of the different formulations above (Example 2 & 3), it is observed that those with an acid concentration of >5% remove the smut/oxide (both original and newly formed) entirely. The formulations with acid levels of 5% or less leave an appreciable amount of smut on the sample surface. Even though adhesion is not an issue in the laboratory with compositions containing low acid levels, the robustness of the process over time could be questioned for formulations that consistently leave a smut on the surface.

Determining the amount of elemental Copper remaining free in solution was essential in providing a final formulation. When processing high copper level aluminum alloys (2XX.X or 2XXX), it is imperative that the desmut solution does not specifically attack the copper in the alloy. If an appreciable amount of Cu is removed from a high Cu alloy the desmut solution can quickly become rich of free Cu. This free Cu in solution will result in immersion plate-out of Cu onto any alloy processed afterwards. With all of the above formulations the Cu in solution is <10 ppm after 3 hours of processing. Dpending upon the type of chemistry used for processing, usually 0.75 g/L - - - 2.0 g/L of free Cu is required in solution before immersion occurs. An easy test to see whether a given solution dissolves Cu from a Cu rich substrate is too simply place a piece of 101 Cu alloy into the desmut solution. After about an hour check the solution (via AA, ICP) to how much Cu was dissolved into solution.

| Formulation: | Cu in solution: |
|---|---|
| 30 g/L MBS<br>10% Sulfuric Acid<br>2.5 g/L ABF | After 1 Hr 3.7 ppm<br>After 2 Hrs 7.1 ppm<br>After 3 Hrs 8.9 ppm<br>After 4 Hrs 10.4 ppm |

What is claimed is:

1. A composition, free of nitric acid and chromic acid, for desmutting an aluminum surface which contains:

a) an oxidant selected from nitrobenzene sulfonic acids, benzenesulfonic acids or their salts, b) an acid selected from the group phosphoric acid, polyphosphoric acid, hypophosphoric acid, metaphosphoric acid, orthphosphoric acid, pyrophosphoric acid, sulfuric acid, sulfurous acid, fluoroboric acid, acetic, gluconic, glycollic, chloroacetic, di chloroacetic, and tri-chloroacetic acid, and c) optionally, a halide ion-containing compound.

2. The composition of claim 1 wherein the oxidant is Benzenesulfonic acid, 4-ethylbenzenesulfonic acid; 3 nitrobenzenesulfonic acid, or their salts.

3. A composition according to claim 1 where the oxidant is meta-nitrobenzene sulfonic acid.

4. A composition according to claim 1 where the acid is sulfuric acid.

5. A composition according to claim 1 where the oxidant is meta-nitrobenzene sulfonic acid, and the acid is sulfuric acid.

6. A composition according to claim 1 where the optional halide containing compound is ammonium hydrogen fluoride.

7. A composition according to claim 1 where the optional halide containing compound is sodium hydrogen fluoride.

8. The composition of claim 1 wherein the composition is an aqueous solution comprising:

a) oxidant: 0.5 to about 200 g/L b) acid: 1.0% to about 50% by vol.

c) halide containing compound: 0.0 to about 100 g/L.

9. The composition of claim 1 comprising:

20–40 g/L oxidant,

5–20% by volume of concentrated (97–98%) acid, and

2–3 g/L Fluoride containing compound.

10. The composition of claim 9 comprising:

a) m-nitrobenzene sulfonic acid, sodium salt: 0.5 to about 200 g/L b) Sulfuric acid: 1% to about 50% by volume c) Fluoride-ion: 0.2 to about 100 g/L.

11. The composition of claim 10 comprising:

about 20–40 g/L (MBS) m-nitrobenzene sulfonic acid, about 5–15% by wolume of concentrated (97–98%) sulfuric acid, and about 1–5 g/L ammonium hydrogen fluoride.

* * * * *